United States Patent [19]

Perfetti

[11] Patent Number: 4,959,012

[45] Date of Patent: Sep. 25, 1990

[54] APPARATUS FOR REPAIRING BRICK/REFRACTORY IN A PROCESS HEATER

[75] Inventor: Gary L. Perfetti, Collinsville, Ill.

[73] Assignee: Shell Oil Company, Houston, Tex.

[21] Appl. No.: 407,505

[22] Filed: Sep. 14, 1989

[51] Int. Cl.[5] ..... F27D 23/00

[52] U.S. Cl. ..... 432/76; 432/3; 432/248; 110/336

[58] Field of Search ..... 432/3, 76, 248, 249; 110/336, 338

[56] References Cited

U.S. PATENT DOCUMENTS

| | | | |
|---|---|---|---|
| 2,101,786 | 12/1937 | Wise | 432/3 |
| 2,611,330 | 9/1952 | Kirk | 432/3 |
| 4,143,708 | 3/1979 | Haynes | 432/3 |
| 4,432,289 | 2/1984 | Norman et al. | 432/248 |

*Primary Examiner*—Henry C. Yuen

[57] ABSTRACT

An apparatus for securing loose wall brick or refractory lining in process heaters eliminates the need for the assistance of personnel outside the heater. Also, the requirement for scaffolding outside the heater is eliminated. Brick or refractory lining on process heater walls becomes loose and pulls away from the skin because of expansion and contraction over a period of time. The holdback plate assembly may comprise a rod of stainless steel which is threaded at one end (access end) and slotted at the other end (non-access end). A piece of flat bar is pivotally attached off center in the slotted end of the rod thereby allowing it to rotate freely for 90° when unrestrained. The rod is inserted through a hole drilled through the brick and heater wall then positioned such that the flat bar rotates 90° in the slot. A stainless steel plate is then placed over the threaded end of the rod inside the heater and secured snugly in place against the brick by a stainless steel nut thereby preventing further movement of the brick.

2 Claims, 1 Drawing Sheet

APPARATUS FOR REPAIRING BRICK/REFRACTORY IN A PROCESS HEATER

BACKGROUND OF THE INVENTION

Process heaters are required in many industrial applications in refineries, chemical plants, steel mills, etc. They are needed for processing and separating raw materials into usable products. A process heater may be very large, for example, 70 feet high and 50 feet in diameter, and produce temperatures in the range of 1000° F. to 2500° F., depending upon the application. The heater generally utilizes an outer heater skin made of metal with the inside of the heater structure being completely lined with heater brick, refractory or the like. Heater brick is laid one brick at a time whereas refractory is blown onto the skin by machine and creates a solid wall.

During its operational life the heater is repeatedly cycled through its temperature extremes which, in time, causes the brick to become loose and pull away from the skin because of the constant expansion and contraction. This, in turn, results in heat loss which eventually reaches an unacceptable point and requires repair work on the wall.

The invention is directed to a method and apparatus for repairing such damage in an expeditious manner, but which is acceptable engineering-wise and which results in minimum expense and downtime.

SUMMARY OF THE INVENTION

The invention is directed to a method and apparatus for repairing loosened wall brick (or refractory) in a process heater. The term "brick," "wall brick" or "heater brick" is hereinafter used to describe the invention and is intended to include refractory. A hole is drilled from inside the heater, through the loosened wall brick and extends through the metal heater skin. A tension rod of appropriate material and size has a slot cut in one end and is threaded on the other. A flat metal pivot plate, having approximately the same width as the diameter of the rod, is pivotally secured in the slot so as to allow it to freely rotate therein when unrestrained. The pivot plate is secured off its longitudinal center, that is, one end is longer than the other with respect to the pivot point. Thus, when the slot of the tension bar is rotated to a vertical position, the flat pivot plate, if unrestrained, will pivot 90° in the slot (since its pivot point is off center). The opposite end of the tension rod is threaded so as to accept a mating nut. The tension rod is inserted in the drilled hole, slotted end first, and with the pivot plate aligned with the rod. When the pivot plate clears the heater skin, the unrestrained pivot plate rotates 90° to a vertical position thereby preventing withdrawal of the tension rod. A pressure plate (brick holdback plate) is then placed over the tension rod and the mating nut is tightened to prevent further movement of the brick away from the heater skin.

DESCRIPTION OF THE PREFERRED EMBODIMENT

Process heaters are extensively used in industry and are very large and expensive. The heater, for purposes of this application, is a metal shell lined with material such as heater brick or refractory. As noted, the heater brick is laid one brick at a time, much like as in a brick wall or home. The brick is anchored to the inside of the metal skin by selective anchors between the brick and skin. In operation, the heater temperature is elevated by the use of gas, oil or coal burners. Over a period of time, the temperature cycling may cause the brick to pull away from the metal lining because of the repeated expansion and contraction caused by the temperature changes. The heater becomes increasingly less efficient to operate until it reaches an unacceptable point at which time the wall must be repaired. If the loose brick is not repaired and falls away, the intense heat will burn a hole through the exposed metal skin.

Prior to the instant invention, process heater walls were repaired by inserting a tension rod through the brick and heater skin and welding the tension rod to the outside of the heater skin. This method and apparatus required access to both the inside of the heater (brick lining) and to the outside of the heater shell. Because of the size of the heater, access scaffolding was also required on both sides of the heater. This scaffolding could be 50–60 feet high and completely enclose the heater, thus being very expensive. The procedure also required working crews inside and outside the heater to install the securing apparatus.

Figure 1:
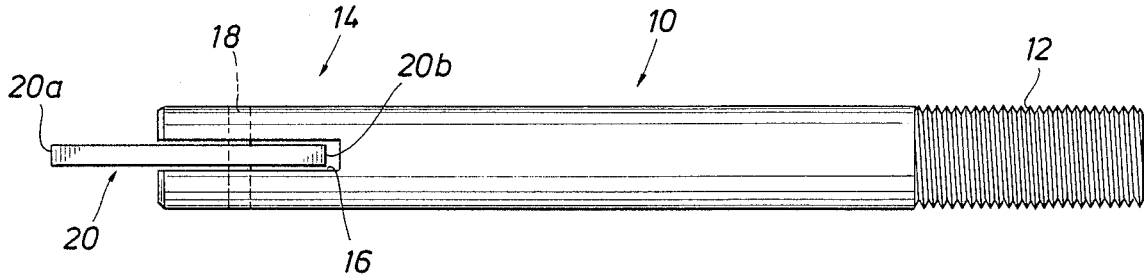
FIG. 1 is a cross-sectional plan view of the brick holdback assembly of the present invention.

Referring now to FIG. 1, a pressure or tension rod 10 has a threaded end 12 and a slotted end 14. A slot, generally designated as 16, is centered on a diameter of the rod 10 and cut therethrough. A pivot pin 18 is inserted on a diameter orthogonal to the slot 16 with a pivot plate 20 pivotally secured thereto. Thus, the plate 20, when unrestrained, is free to pivot about the pin 18 within the slot 16. The plate 20 has a length and thickness sufficient to withstand any pressures (tension) applied to the rod 10. The pivot point, however, is offset on the plate 20 with respect to its length. That is, one end **20*a* of plate 20 is farther from the pivot point than the other end 20*b***.

Figure 2:
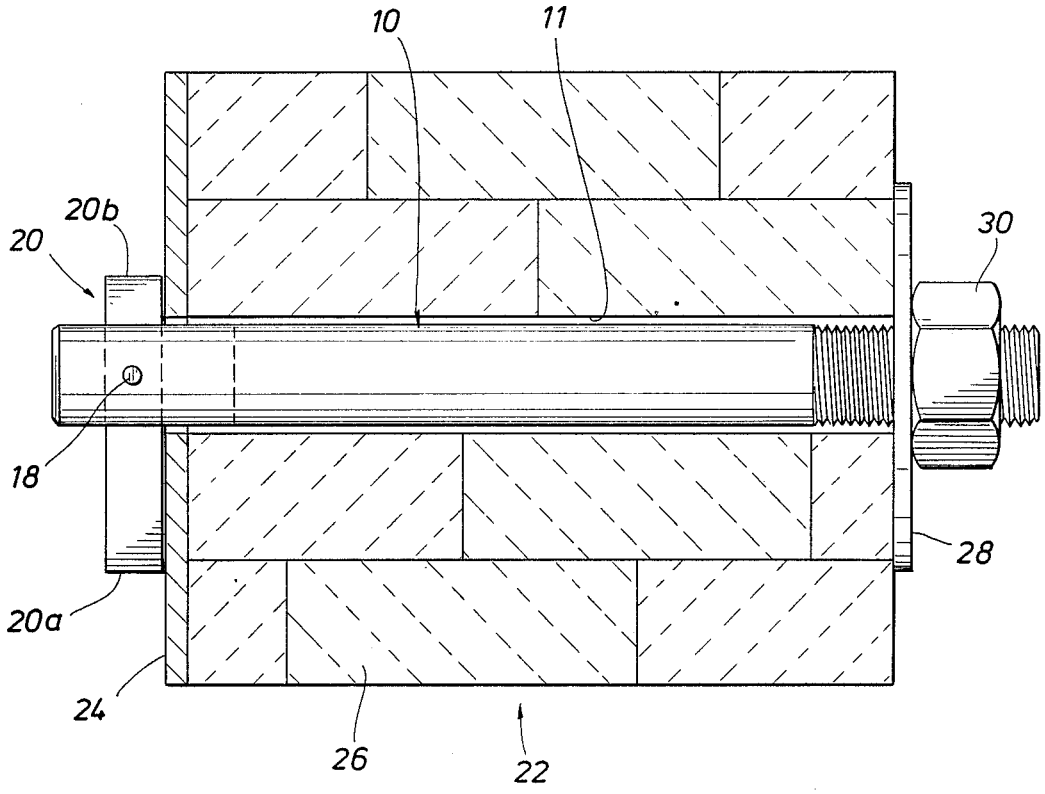
FIG. 2 is a cross-sectional view of the process heater wall with the tension rod, pivot plate and holdback plate in position.

FIG. 2 is a sectional view of the tension rod 10 installed in a process heater wall generally designated as 22. The heater wall 22 is comprised of the outside heater skin 24 to which is attached the heater brick 26. The rod 10 extends through a hole 11 which has been drilled from inside the heater, through the brick 26 and the outside heater skin 24. For installation, the rod 10 is inserted in the drilled hole 11 with the slot 16 in a vertical position and the pivot plate 20 having been axially aligned with the rod 10. When the rod 10 and the entire length of pivot plate 20 penetrate through the heater skin 24, the plate 20 will no longer be restrained and will pivot 90° to a vertical position from which position the tension rod 10 cannot be withdrawn through the hole 11. A brick holdback plate 28 is placed on the rod 10, in the manner of a washer, and a nut 30 is then threaded on the rod 10 and tightened snugly to prevent the brick 26 from moving any further away from the heater skin 24.

The tension rod 10, pivot plate 20, pivot pin 18, holdback plate 28 and nut 30 may be made of any acceptable material such as stainless steel. The selected material may depend upon the temperature extreme of the heater.

In one application, the tension rod 10 comprised a $\frac{5}{8}''$ diameter rod 14" long. The pivot plate 20 was a 3/16"$\times\frac{5}{8}''$ flat plate $3\frac{1}{2}''$ long. The pivot pin 18 was $\frac{1}{4}''$ diameter with its pivot point on plate 20 offset from the longitudinal center such that the ends were $1\frac{1}{2}''$ and 2" respectively from the center of the pivot point. This allowed sufficient imbalance to force the pivot plate 20 to assume a vertical position when unrestrained. All parts were made of stainless steel. The maximum length of the pivot plate 20 is determined by the available clearance space between the outside heater skin 24 and any obstruction therebehind.

What is claimed is:

1. An apparatus for securing loose wall brick or refractory lining in a process heater comprising:

a tension rod, having a threaded end and a slotted end, for insertion into a hole drilled in the wall of said process heater at the location of said loose wall brick;

a pivot plate pivotally secured in said slotted end such that, when said slot is in a vertical position and said pivot plate is unrestrained, said pivot plate will pivot to a vertical position whereby it may be pulled against the outside of said process heater and prevent removal of said tension rod from said hole;

a pressure plate which may be placed over said threaded end of said tension rod and into contact with said wall brick; and a nut threaded on said threaded end of said tension rod and against said pressure plate whereby said nut can be tightened thereby applying pressure on said heater wall which is between said pivot plate and said pressure plate and preventing further movement of said brick.

2. The apparatus of claim 1 wherein said pivot plate is non-symmetrical along its longitudinal axis with respect to the pivot point.

* * * * *